US008917879B2

(12) United States Patent
Sato et al.

(10) Patent No.: US 8,917,879 B2
(45) Date of Patent: Dec. 23, 2014

(54) ACTIVE MUFFLER

(75) Inventors: Yasushi Sato, Kitakyushu (JP); Atsuko Ryu, Kitakyushu (JP)

(73) Assignee: Kyushu Institute of Technology, Kitakyushu-Shi, Fukuoka (JP)

( * ) Notice: Subject to any disclaimer, the term of this patent is extended or adjusted under 35 U.S.C. 154(b) by 976 days.

(21) Appl. No.: 13/001,937

(22) PCT Filed: Jul. 8, 2009

(86) PCT No.: PCT/JP2009/062476
§ 371 (c)(1),
(2), (4) Date: Dec. 29, 2010

(87) PCT Pub. No.: WO2010/005038
PCT Pub. Date: Jan. 14, 2010

(65) Prior Publication Data

US 2011/0110527 A1 May 12, 2011

(30) Foreign Application Priority Data

Jul. 9, 2008 (JP) ..... 2008-179397

(51) Int. Cl.

| | |
|---|---|
| ***G10K 11/16*** | (2006.01) |
| ***G10K 11/178*** | (2006.01) |
| *H04R 3/02* | (2006.01) |
| *H04R 3/04* | (2006.01) |

(52) U.S. Cl.
CPC ..... *G10K 11/178* (2013.01); *H04R 3/02* (2013.01); *H04R 3/04* (2013.01); *G10K 2210/3212* (2013.01); *H04R 2400/00* (2013.01); *G10K 2210/12* (2013.01)
USPC ..... 381/71.8

(58) Field of Classification Search
CPC ... G10K 11/16; G10K 11/175; G10K 11/178; G10K 11/1782–11/1788; G10K 2210/106; G10K 2210/112; G10K 2210/12; G10K 2210/3212; H04R 3/02; H04R 3/04; H04R 2400/00
USPC ..... 381/71.1–71.9, 71.11–71.14, 93, 381/94.1–94.9, 408, 422, 431; 700/94
See application file for complete search history.

(56) References Cited

U.S. PATENT DOCUMENTS 5,699,437 A * 12/1997 Finn ..... 381/71.7
5,995,260 A 11/1999 Rabe (Continued)

FOREIGN PATENT DOCUMENTS

| | | | |
|---|---|---|---|
| JP | 5-61480 | A | 3/1993 |
| JP | 2005-105774 | A | 4/2005 |
| JP | 2007-321332 | A | 12/2007 |

OTHER PUBLICATIONS

International Search Report (PCT/ISA/210) issued on Aug. 4, 2009, by Japanese Patent Office as the International Searching Authority for International Application No. PCT/JP2009/062476.

*Primary Examiner* — Paul McCord
*Assistant Examiner* — Alexander Eljaiek
(74) *Attorney, Agent, or Firm* — Buchanan Ingersoll & Rooney PC

(57) ABSTRACT

In an active muffler having improved response characteristics, a speaker section includes a diaphragm adapted to generate sound, a voice coil for driving the diaphragm, and a distance sensor to detect the movement of the diaphragm. A light generated by the LED is reflected by the diaphragm, the reflected light is detected by a phototransistor to thereby measure the distance to the diaphragm, so that the movement of the diaphragm is detected. Noise is detected by a microphone, and a signal having opposite phase to that of the noise is generated by an opposite-phase generating section. The difference between the opposite-phase signal and the signal of the distance to the speaker from the distance sensor is calculated and inputted to a PID control section. Such a difference indicates the delay of the speaker movement. Feedback control is performed in a direction in which the difference is canceled out.

2 Claims, 6 Drawing Sheets

(56) References Cited

U.S. PATENT DOCUMENTS 6,483,926 B1 * 11/2002 Yamashita et al. ..... 381/71.7
7,912,239 B2 * 3/2011 Nishimura et al. ..... 381/396
2001/0031052 A1 * 10/2001 Lock et al. ..... 381/71.7
2002/0159606 A1 * 10/2002 Hobelsberger ..... 381/96
2005/0031139 A1 * 2/2005 Browning et al. ..... 381/96

* cited by examiner

FIG. 2A
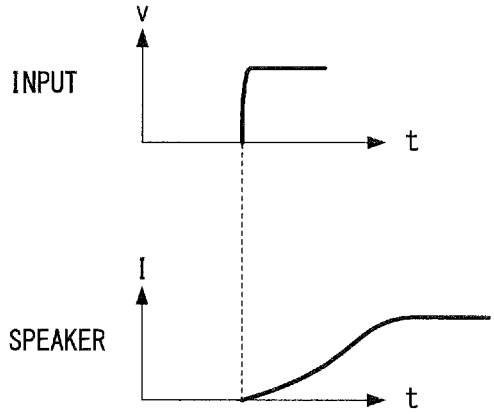
FIG. 2B
FIG. 3
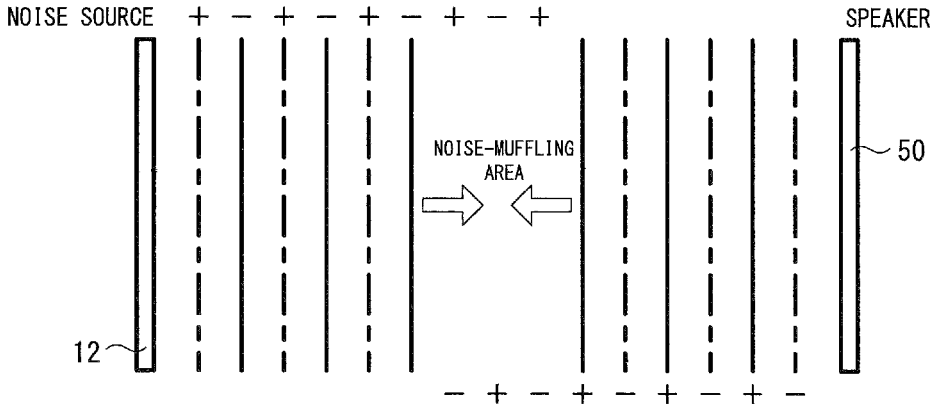

ACTIVE MUFFLER

BACKGROUND

1. Field of the Invention

The present invention relates to an active muffler that muffles noise by generating a sound having opposite phase to that of the noise, particularly to a muffler having improved response characteristics.

2. Description of Related Art

A muffler that actively muffles noise by generating a sound having opposite phase to that of the noise has been used since long time ago.

FIG. 1-1 is a view schematically showing how noise is muffled by an active muffler. As shown in FIG. 1-1, in order to cancel out the noise coming from a noise source 10 at a place where a person 50 is present, the active muffler picks up the noise from the noise source with a microphone 20, amplifies the noise signal in opposite phase with an amplifier 30, and generates a sound having opposite phase with a speaker 40.

FIG. 1-2 shows a concrete configuration example for actively muffling noise. The noise is converted into an electrical signal by a microphone A20, the electrical signal is processed by an adaptive filter 32 so that a sound suitable to muffle the noise is generated when being played by the speaker 40, and the signal processed by the adaptive filter 32 is amplified by the amplifier 30 and then outputted by the speaker 40. The outputted sound cancels out the noise, and a monitoring microphone B34 detects whether or not the noise has been suitably muffled. An electrical signal converted by the monitoring microphone B34 is fed back to the adaptive filter 32 where a coefficient of the adaptive filter 32 is changed so that a suitable sound can be generated by the speaker 40.

These configurations are mostly achieved by converting the inputted electrical signal into a digital signal, and performing digital signal processing on the digital signal by using a DSP (digital signal processor). Refer to, for example, Patent Document 1 for details of the active muffler.

One of the problems with the use of the speaker of the muffler is response lag caused by the speaker, as indicated by graphs of FIGS. 2A and 2B. FIG. 2A is a graph of input signal to the speaker, and FIG. 2A is a graph indicating the movement of the speaker.

As indicated by the graphs of FIGS. 2A and 2B, in the case where a step input signal shown in FIG. 2A is applied to an ordinary dynamic speaker having a voice coil, the speaker will cause an operating delay on rising edge as shown in FIG. 2B. When such operating delay is caused, it will not be possible to sufficiently perform sound-muffling at the moment when the sound-muffling operation is started if the distance between the speaker and the sound-muffling area is small.

Further, in the case where noise is generated from a flat surface (for example, a floor of an upstairs room of an apartment building), a flat speaker having a flat diaphragm and capable of generating a plane wave may be used to cancel out the noise. A case where a flat speaker is used to cancel out such noise will be described below with reference to FIG. 3. In FIG. 3, noise is generated from a flat surface 12. Since the noise is generated from the flat surface 12, the noise propagates through air as a plane wave. On the other hand, when a plane wave having opposite phase to that of the noise is generated from a flat speaker 50, the wave crest (+) and the wave trough (−) of the plane wave of the noise and the wave crest (+) and the wave trough (−) of the plane wave of the generated sound will coincide with each other and therefore completely cancel out each other, so that the noise is muffled.

In the case where a flat speaker is used to cancel out the noise generated from a large flat surface, it is necessary to drive a flat diaphragm using a plurality of voice coils. However, due to variation in characteristics of the plurality of the voice coils, the flat diaphragm can not be uniformly driven, and that is a problem.

Refer to, for example, Patent Document 2 for details of a configuration in which a flat speaker is used to actively muffle noise.

Patent Document 1: Japanese Unexamined Patent Application Publication No. Hei 5-61480

Patent Document 2: Japanese Unexamined Patent Application Publication No. 2007-321332

BRIEF SUMMARY OF THE INVENTION

It is an object of the present invention to provide a muffler capable of reducing delay in output of a speaker for canceling out the noise from the time when noise has been inputted.

Further, it is another object of the present invention to provide a muffler capable of performing sound-muffling on a large area by a flat speaker having a large surface driven by a plurality of voice coils, in which influence caused by piece-to-piece variations in characteristics of the plurality of voice coils is reduced.

To achieve the aforesaid objects, an active muffler according to an aspect of the present invention includes: a microphone adapted to detect noise and output a noise signal; a speaker; an opposite-phase signal generating section adapted to input the noise signal and generate a signal having opposite phase to that of the noise signal; a distance sensor adapted to detect the distance to a diaphragm of the speaker and output a signal; and a feedback control section adapted to input the opposite-phase signal of the opposite-phase signal generating section and the signal of the distance sensor, perform feedback control so that the signal of the distance sensor becomes closer to the opposite-phase signal, and drive the speaker.

Further, an active muffler according to another aspect of the present invention includes: at least one microphone adapted to detect noise and output a noise signal; a flat speaker having a flat diaphragm driven by n pieces (n is a natural number equal to or more than 2) of voice coils; an opposite-phase signal generating section adapted to input the noise signal and generate a signal having opposite phase to that of the noise signal; n pieces of distance sensors respectively arranged near the n pieces of voice coils and each adapted to detect the distance to the diaphragm and output a signal; and n sets of feedback control sections adapted to input the opposite-phase signal of the opposite-phase signal generating section and the signals of the n pieces of distance sensors, perform feedback control so that the signals of the distance sensors become closer to the opposite-phase signal, and drive the voice coils arranged near the respective distance sensors.

The feedback control section may perform a PID control based on a difference signal between the signal from the distance sensor and the opposite-phase signal from the opposite-phase signal generating section.

The distance sensor may be an optical sensor configured by a LED and a phototransistor, in which light from the LED is irradiated on the diaphragm, and the light reflected from the diaphragm is detected by the phototransistor to thereby measure the distance to the diaphragm.

The distance sensor may also be a capacitance sensor in which the capacitance between electrodes provided between the diaphragm and the distance sensor is detected to thereby detect the distance to the diaphragm.

With such configuration, it is possible to perform the feedback control on the movement of the diaphragm of the speaker to therefore improve the response characteristics of the speaker. Thus, it is possible to muffle impact noise.

Further, in the flat speaker having the flat diaphragm, since the flat diaphragm is driven by a plurality of voice coils, and since the plurality of plurality of voice coils are each provided with a distance sensor in the vicinity thereof so as to form a plurality of feedback loops, it is possible to muffle impact noise by a plane wave. Further, since variations in characteristics of the voice coils can be canceled out by the feedback control, it is possible to generate better plane wave.

DETAILED DESCRIPTION

Brief Description of Drawings

FIG. 1-2 is a configuration example of the active muffler shown in FIG. 1-2.

FIGS. 2A and 2B are graphs showing response characteristics of a flat speaker, wherein FIG. 2A shows an input signal, and FIG. 2B shows operation of the speaker.

FIG. 3 is a view showing how noise is muffled in a case where noise is a plane wave.

FIGS. 4A and 4B are views schematically showing a configuration according to an embodiment of the present invention, wherein FIG. 4A shows a configuration of a speaker, and FIG. 4B shown a configuration of a drive circuit.

FIGS. 5A, 5B, 5C, and 5D are graphs for explaining the operation of the embodiment of the present invention, wherein FIG. 5A is a graph for explaining a drive signal, FIG. 5B is a graph for explaining the operation of the speaker, FIG. 5C is a graph for explaining the frequency characteristics of a feedback loop, and FIG. 5D is a graph for explaining a drive signal after feedback.

FIGS. 6A and 6B show a configuration of a muffler with a flat speaker driven by a plurality of voice coils, wherein FIG. 6A shows a configuration of a speaker, and FIG. 6B shows a configuration of a drive circuit.

FIG. 7-1 is a view showing an example for muffling the noise from a floor of an upstairs room of an apartment building or the like.

FIGS. 7-2A and 7-2B are views showing a detail configuration of a driving section of FIG. 7-1, wherein FIG. 7-2A shows a configuration for supporting and driving a speaker, and FIG. 7-2B shows how a diaphragm is driven by two voice coils.

An embodiment of the present invention will be described below with reference to the attached drawings.

Figure 4A:
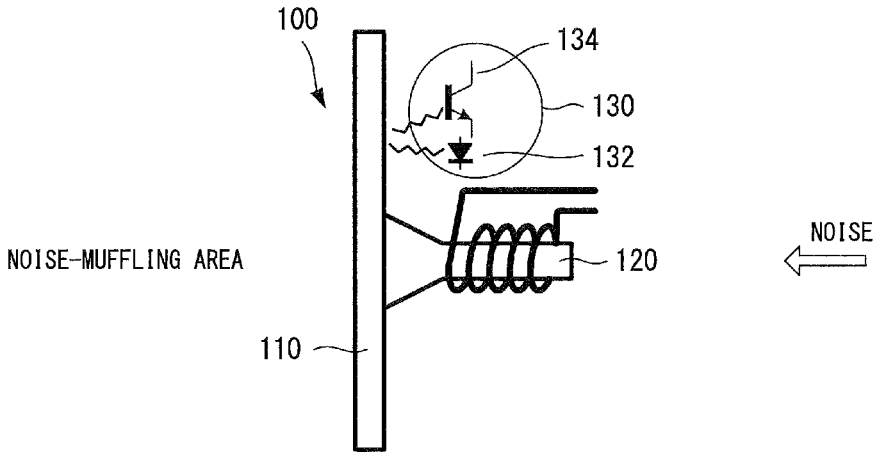
Figure 4B:
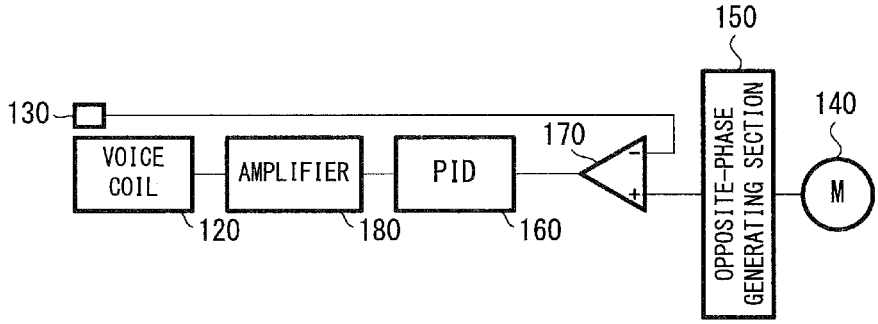

FIGS. 4A and 4B schematically show a configuration of an active muffler 100 according to an embodiment of the present invention.

FIG. 4A shows a configuration of a speaker section of the active muffler 100, and FIG. 4B shows a circuit configuration of the active muffler 100.

The speaker section of FIG. 4A includes a diaphragm 110 adapted to generate sound, a voice coil 120 for driving the diaphragm, and a distance sensor 130 adapted to detect the movement of the diaphragm. Although FIG. 4A shows an example in which a flat diaphragm is used as the diaphragm 110, the diaphragm may also be cone-shaped.

Further, in the configuration shown in FIG. 4A, a distance sensor using light reflection is used as the distance sensor 130. As shown in FIG. 4A, light generated by the LED 132 is reflected by the diaphragm 110, and the light reflected by the diaphragm 110 is detected by a phototransistor 134 to thereby measure the distance to the diaphragm, so that the movement of the diaphragm 110 is detected. The distance sensor 130 may also be a capacitance sensor in which electrodes are provided between the diaphragm 110 and the sensor 130, and the capacitance between the electrodes is detected to thereby detect the distance.

Figure 1:
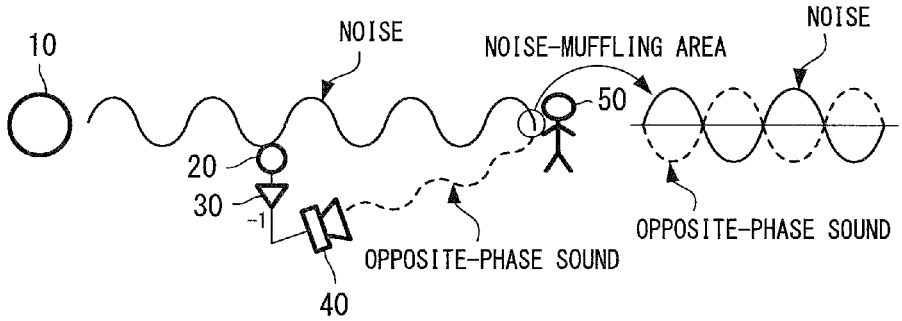
FIG. 1-1 is a view schematically showing a configuration of an active muffler.
Figures 1, 2:
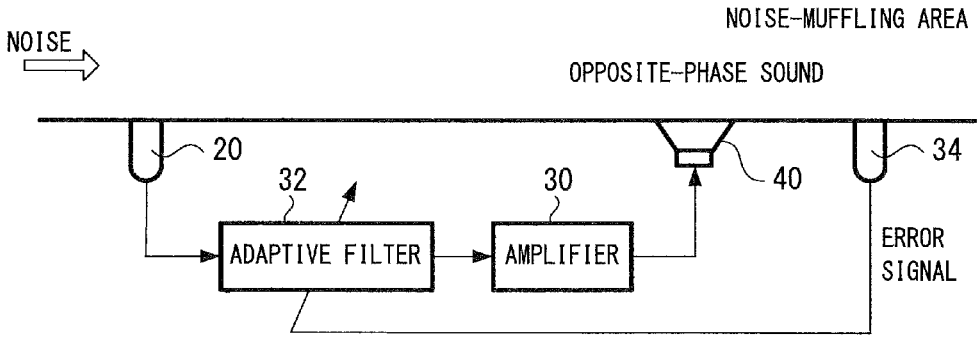

In the circuit of FIG. 4B, the noise is detected by a microphone 140, and a signal having opposite phase to that of the noise is generated by an opposite-phase generating section 150. For example, the opposite-phase generating section 150 may have a circuit configuration as shown in FIG. 1-2, in which an adaptive filter having a feedback by a monitoring microphone is used. Incidentally, the microphone 140 is arranged at a place suitable to detect the noise.

The difference between the opposite-phase signal from the opposite-phase generating section 150 and the signal of the distance to the speaker from the distance sensor 130 is calculated by a differential amplifier 170, and the result is inputted to a PID control section 160. Such a difference (deviation e) indicates the delay of the movement of the speaker. A feedback control is performed by the PID control section 160 in a direction to cancel out the difference.

The PID control is a known control; is a combination of a P calculation (i.e., a proportional calculation), an I calculation (i.e., an integral calculation), and a D calculation (i.e., a derivative calculation); and is achieved by adding and combining three actions which are: a P action (i.e., a proportional action) for providing a correction amount proportional to a current deviation e, an I action (i.e., an integral action) for providing a correction amount proportional to a cumulative value of past deviations e, and a D action (i.e., a derivative action) for providing a correction amount proportional to magnitude of a trend which indicates whether the deviation e is increasing or decreasing.

In the PID control, when a gap is caused between a target value and an actual value (i.e., when a deviation e is caused), the proportional action performs a "rapid-response follow-up operation" for rapidly responding to the change of the deviation e, the integral action performs a "continuous follow-up operation" for continuously providing control output until the deviation e becomes zero (i.e., until the target value and the actual value become equal to each other), and the derivative action predicts the coming movement based on the rate of change of the deviation e and performs a "predictive follow-up operation" in correspondence to the prediction. In other words, the PID control is achieved by performing a combination of the "rapid-response follow-up operation", the "continuous follow-up operation" and the "predictive follow-up operation" with respect to the change.

The circuit of FIG. 4B may also be achieved by converting the analog signal into a digital signal, performing digital signal processing with a DSP (Digital Signal Processor) or the like, converting the digital signal into an analog signal, amplifying the analog signal, and then driving the voice coil 120.

Figure 5A:
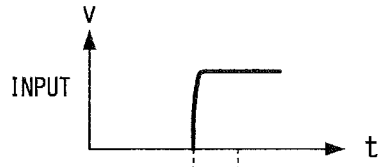
Figure 5B:
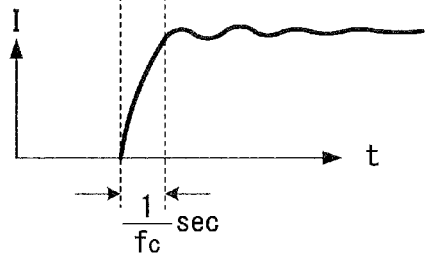
Figure 5C:
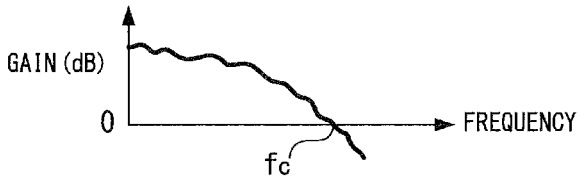
Figure 5D:
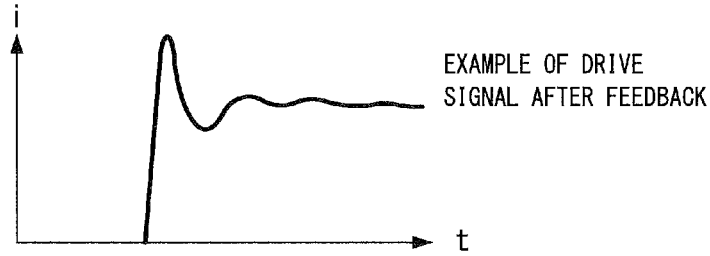

The effect of using such a feedback control to drive the diaphragm of the speaker will be described below with reference to FIGS. 5A, 5B, 5C and 5D. FIG. 5A shows a drive signal to be applied to the voice coil shown in FIGS. 4A and 4B before feedback, and is identical to the drive signal shown in FIG. 2A. FIG. 5B shows operation of the speaker (the diaphragm 110) after feedback; FIG. 5C shows frequency characteristics of a feedback loop which is configured by the distance sensor 130, the differential amplifier 170, the PID control section 160, an amplifier 180, the voice coil 120, and the diaphragm 110; and FIG. 5D shows an example of a drive signal (the output of the amplifier 180) after feedback. As shown in FIG. 5C, $f_0$ represents a frequency when gain is 0, which is a frequency characteristic of the feedback loop.

As shown in FIG. 5B, the response characteristics of the speaker, which are determined by the frequency characteristics of the feedback loop, are sufficiently improved.

Thus, by using the active muffler 100 shown in FIGS. 4A and 4B, it is possible to well follow up and muffle noise even if the noise is impulsive noise (i.e., impact noise).

Figure 6A:
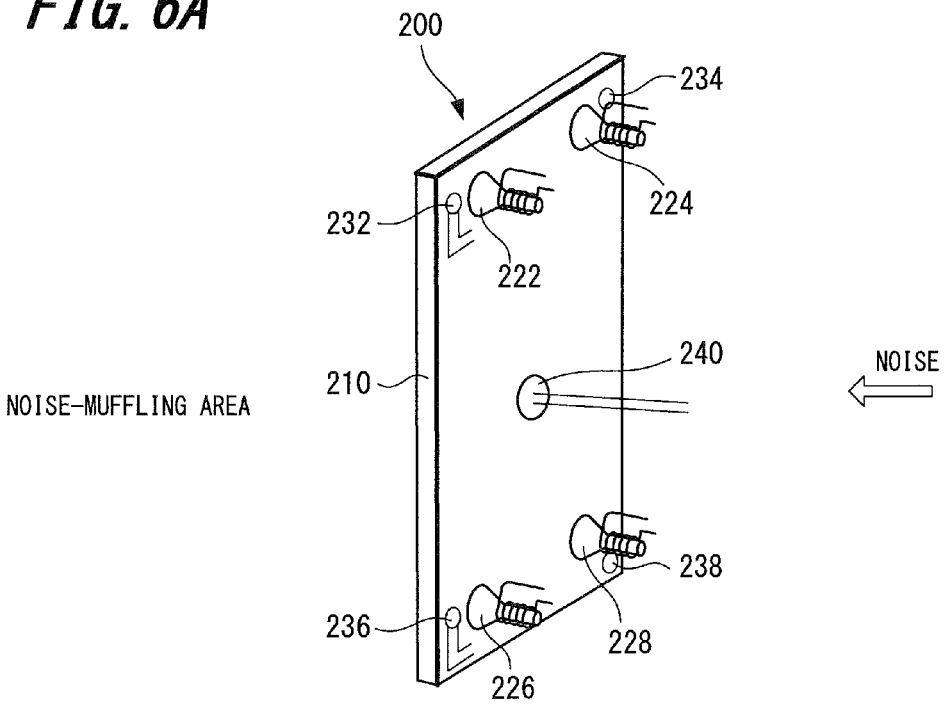
Figure 6B:
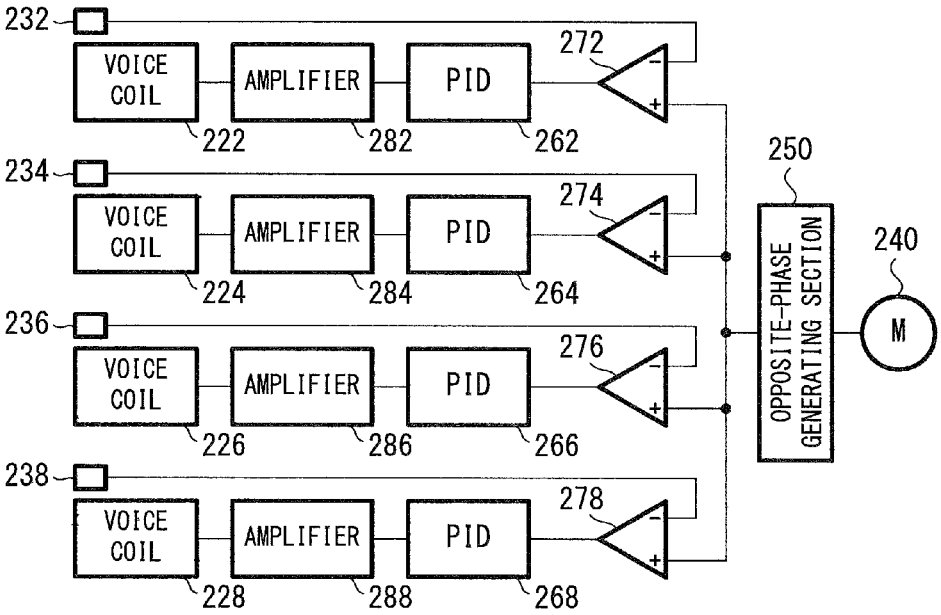

FIGS. 6A and 6B show a configuration of an active muffler 200 in which a large flat diaphragm is driven by a plurality of voice coils, wherein FIG. 6A shows a configuration of a speaker section, and FIG. 6B shows a circuit. Incidentally, the noise comes from the right side of FIG. 6A, and control is performed so that the noise is muffled by the active muffler 200 on the front face of a diaphragm 210 (i.e., the left side of FIG. 6A).

As shown in FIG. 6A, four voice coils 222, 224, 226, 228 for driving the flat diaphragm are provided at four corners of the rectangular flat diaphragm 210. Further, distance sensors 232, 234, 236, 238 are respectively provided near the voice coils 222, 224, 226, 228 to detect the movement of the flat diaphragm driven by the voice coils. Further, a microphone 240 for detecting the noise is provided near the center of the diaphragm 210. Incidentally, the microphone 240 is disposed so as not to contact the diaphragm 210.

In the circuit shown in FIG. 6B, the noise is detected by a microphone 240 and inputted to an opposite-phase generating section 250, so that a signal having opposite phase to that of the noise is generated. The opposite-phase generating section 250 has the same configuration as that of the opposite-phase generating section 150 shown in FIG. 4B.

The signal from the opposite-phase generating section 250 is inputted to one side of each of differential sections 272, 274, 276, 278, which are each a portion of a feedback loop for each of the voice coils. The outputs of the distance sensors 232, 234, 236, 238 arranged near the voice coils 222, 224, 226, 228 are applied to the other sides of the differential sections 272, 274, 276, 278. The outputs from the differential sections 272, 274, 276, 278 are respectively outputted to the voice coils 222, 224, 226, 228 through PID control sections 262, 264, 266, 268 and amplifiers 282, 284, 286, 288.

The configuration of the feedback loop for each of the voice coils is identical to the circuit configuration for the voice coil shown in FIG. 4A, and the operation is also identical.

Thus, by performing feedback loop control for each of the voice coils that drive the flat diaphragm, not only the response characteristics can be improved, but also piece-to-piece variation in characteristics of the voice coils can be reduced in the case where a plane wave is generated by the larger flat diaphragm.

Since the large flat diaphragm can be driven by using the plurality of such voice coils, it is also possible to muffle a floor impact noise coming from an upstairs room of an apartment building by setting the muffler on the ceiling of the apartment building, and to muffle a noise coming from an adjoining space by using setting the muffler on a partition plate of an office.

Incidentally, in the configuration described with reference to FIGS. 6A and 6B, there is only one microphone for detecting the noise, and a single opposite-phase signal is inputted to the respective voice coils, however the present invention includes an alternative configuration in which a plurality of microphones are employed to detect noise in different places, and each of different signals is generated for each of the voice coils for driving the diaphragm so as to muffle the noise. Further, although the number of the voice coils for driving the flat diaphragm is four in the configuration shown in FIGS. 6A and 6B, the number of the voice coils for driving the flat diaphragm may be any suitable number instead of being limited to four.

EXAMPLES

There are a lot of noise problems caused by a floor impact noise coming from an upstairs room of an apartment building or the like. An example of coping with the floor impact noise with the active muffler shown in FIGS. 6A and 6B will be described below with reference to FIGS. 7-1, 7-2A and 7-2B.

Figures 1, 7:
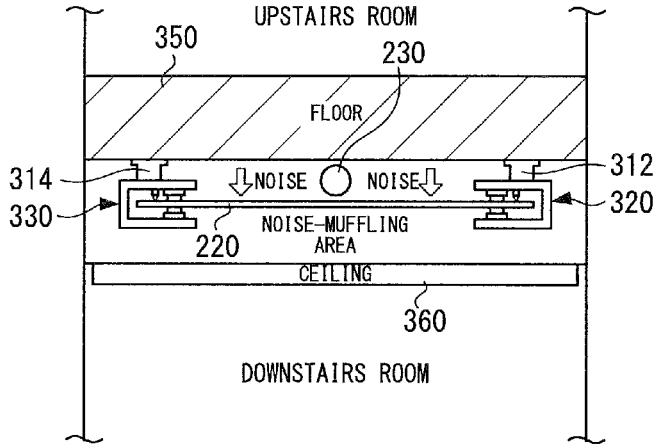
Figures 2A, 7:
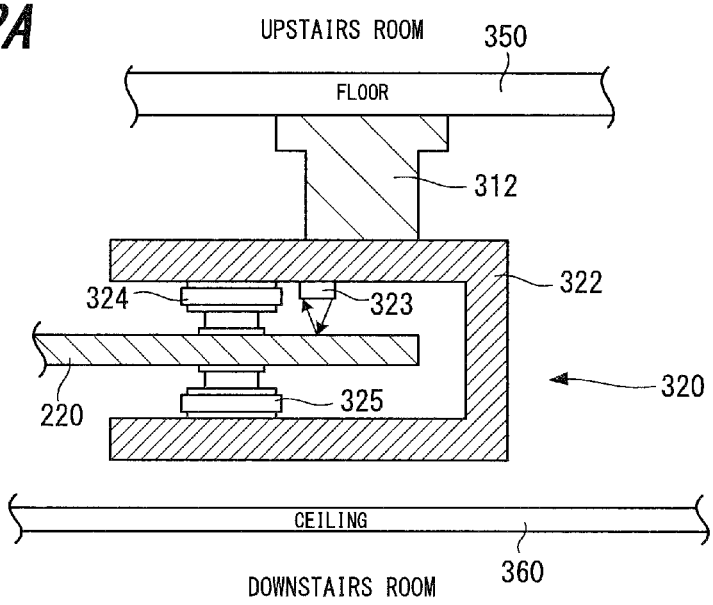
Figures 2B, 7:
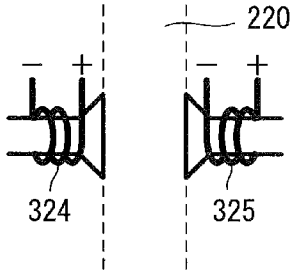

FIG. 7-*i* schematically shows an entire configuration of an active muffler set in a ceiling portion of an apartment building; FIG. 7-2A shows a detail configuration of one of four driving sections and a diaphragm, wherein the four driving sections each have a voice coil incorporated therein; and FIG. 7-2B shows a relation of connection between two voice coils.

FIG. 7-*i* shows a configuration in which a speaker section with a flat diaphragm 220 is arranged in a space between a floor 350 of an upstairs room and a ceiling 360 of a downstairs room of an apartment building. It can be known from FIG. 7-1 that the flat diaphragm 220 is supported by four driving section 320, 330 and the like which have voice coils and the like incorporated therein, and the four driving section 320, 330 are supported by struts 312, 314 and the like from the floor 350 of the upstairs room. Further, a microphone 230 for detecting the noise coming from the upstairs room is arranged near the center of the flat diaphragm. Incidentally, the microphone 230 is disposed so as not to contact the diaphragm 220.

FIG. 7-2A shows the driving section 320. The driving section 320 has two voice coils 324, 325 incorporated therein. The flat diaphragm 220 is sandwiched by the two voice coils 324, 325 so as to be driven by the two voice coils. The two voice coils 324, 325 are arranged in a frame 322 supported from the floor 350 by the strut 312. Further, the frame 322 is provided with a distance sensor 323 in the vicinity of the voice coil to measure the distance to the flat diaphragm 220.

In such a manner, the flat diaphragm 220 is only supported by the four driving sections arranged on the floor of the upstairs room.

As shown in FIG. 7-2B, the same signal is inputted to the voice coils 324, 325 reversely so as to drive the flat diaphragm 220 by push-pull operation. With such a configuration, the flat diaphragm 220 not only can be supported in a state in which the flat diaphragm 220 is sandwiched from up and down directions, but also can be driven by a stronger force than the case where only one voice coil is employed.

Thus, it is possible to muffle the floor impact noise of the upstairs room by setting the active muffler with the flat diaphragm in the space between the floor of the upstairs room and the ceiling of the downstairs room of the apartment building.

The invention claimed is:

1. An active muffler comprising:

at least one microphone positioned in a space between a floor of an upper room and a ceiling of a lower room to detect noise from the upper room and output a noise signal;

a flat speaker having a flat diaphragm spaced from the microphone;

drive sections each supporting the flat diaphragm of the flat speaker to drive the flat diaphragm with n pieces of voice coils, n being a natural number equal to or more than 2, each of the drive sections including a respective support member supporting the drive section from the floor of the upper room, with the flat diaphragm located in the space;

an opposite-phase signal generating section adapted to input the noise signal outputted from the microphone and generate a signal having a phase opposite that of the noise signal;

n pieces of distance sensors respectively arranged near the n pieces of voice coils and each adapted to detect the distance from itself to the diaphragm and output a signal;

n sets of feedback control sections adapted to input the opposite-phase signal generated by the opposite-phase signal generating section and the signals respectively outputted from the n pieces of distance sensors, perform feedback control so that the value of the signal outputted from each of the n pieces of distance sensors becomes closer to the value of the opposite-phase signal, and drive the n pieces of voice coils, wherein each of the drive sections is configured to sandwich the flat diaphragm of the speaker by a set of two voice coils of the n pieces of voice coils, and a same signal is inputted to each of the two voice coils of the set of two voice coils reversely to drive the flat diaphragm by a push-pull operation, and each of the drive sections includes a frame supporting a corresponding set of two voice coils of the n pieces of voice coils, and the support member for supporting the drive section is provided to the frame.

2. The active muffler according to claim 1, wherein the n pieces of distance sensors are provided to respective frames of the drive sections.

* * * * *